United States Patent [19]

Olivotto

[11] Patent Number: 4,604,149

[45] Date of Patent: Aug. 5, 1986

[54] PROCESS FOR HARDENING ELONGATE METAL ELEMENTS

[75] Inventor: Vanfrido Olivotto, Turin, Italy

[73] Assignee: Olivotto S.p.A., Turin, Italy

[21] Appl. No.: 714,937

[22] Filed: Mar. 22, 1985

[30] Foreign Application Priority Data

Apr. 20, 1984 [IT] Italy ..... 67405 A/84

[51] Int. Cl.[4] ..... C21D 1/00

[52] U.S. Cl. ..... 148/153; 148/155; 266/114; 266/121

[58] Field of Search ..... 148/128, 146, 153, 155, 148/156; 266/102, 103, 114, 111-113, 274, 249, 121

[56] References Cited

U.S. PATENT DOCUMENTS 3,255,053 6/1966 Bard et al. ..... 148/153
3,915,763 10/1975 Jennings et al. ..... 148/127

FOREIGN PATENT DOCUMENTS 2276390 1/1976 France ..... 148/155
113323 7/1983 Japan ..... 148/153
379641 8/1973 U.S.S.R. ..... 148/153
981392 12/1982 U.S.S.R. ..... 148/153

*Primary Examiner*—Christopher W. Brody
*Attorney, Agent, or Firm*—Frost & Jacobs

[57] ABSTRACT

A process for hardening elongate metal elements having a circular section, according to which the said elements are made to advance through a heating station and a hardening station by a conveyer device formed by a succession of advancement and support devices individually controllable in a direction transverse the said elements in such a way as to maintain the axis of each of the elements always coincident with a predetermined axis of advancement each advancement device being individually controllable in such a way as to impart to each point of each element displacements with a controllable velocity along cylindrical helices the pitch of which can be varied from zero to infinity and, in particular, to impart to each element during the traverse through a current of cooling fluid generated within the said hardening station transversely of the axis advancement, a rotary and translational movement with a velocity variable according to laws depending on the distribution of mass along the element itself.

12 Claims, 4 Drawing Figures

PROCESS FOR HARDENING ELONGATE METAL ELEMENTS

BACKGROUND OF THE INVENTION

The present invention relates to a process for hardening elongate metal elements, in particular solid and hollow circular section rectilinear bars of great length, and including both those with a variable section and those with a constant section.

In general, hardening of a metal bar of the type described above, that is to say a bar having relatively high length/diameter ratio, involves numerous problems both during the heating phase and during the cooling phase which constitutes the hardening phase itself. It is, in fact, clear that a non homogeneous heating of such a bar and, above all, non homogeneous cooling thereof gives rise to internal stresses which are manifested automatically as deformations of the axis of the bar.

In general the heating of the bar of the type described above is performed by utilising vertical furnaces from the top of which the bars, once having reached the hardening temperature, are withdrawn by means of a tower structure and immersed into a cooling tank containing water.

The process described above has been found to be unsuitable for hardening bars of relatively great length in that the heating in the vertical furnace makes it difficult to obtain a uniform temperature along the whole of the bar. Moreover, hardening by immersion in water normally induces in the bars an irregular distribution of stresses due to the formation of cushions of steam constituting an insulating layer.

Because of the above explained disadvantages the bars, once hardened, are normally distorted. In particular, originally rectilinear bars are normally twisted and bent and must be subjected to expensive "reformation" processes by plastic deformation to be brought back to their original rectilinear configuration. The "reformation" of the hardened bars can in part be eliminated in cases in which the bars themselves must be subjected to mechanical working subsequent to hardening. In this case, a relatively thick layer of removable stock can permit the compensation of distortions, but involves a significant waste of material.

SUMMARY OF THE INVENTION

The object of the present invention is that of providing a process for hardening elongated metal elements, which will be free from the above described disadvantages.

The object is achieved by the present invention in that it relates to a process for hardening elongated metal elements, in particular both solid and tubular rectilinear circular section bars, having constant or variable section, and of extended length, characterised by the fact that it comprises the steps of:

positioning each element to be hardened on a conveyer device extending through a heating station and a hardening, cooling station, and comprising a succession of rotatable support and advancement means individually operable in a controllable manner to impart to each point of the element, displacements having a controllable velocity along a respective cylindrical helix maintained, by means of the control of the said rotatable support and advancement means in a direction transverse to the element, always substantially coaxial with an axis of advancement of the element along the conveyer device, the pitch of the helix being adjustable from point to point of the conveyer between a value of zero and an infinite value;

advancing each element within the said heating station by means of the conveyer;

maintaining each element within the said heating station for a predetermined time imparting to it, by means of the rotatable support and advancement means, at least a rotation about the axis of advancement;

providing, within the cooling station, at least one current of heat exchange fluid substantially transverse to the axis of advancement; and advancing each element through the said current of fluid imparting to the points thereof displacements according to respective said cylindrical helices; at least one of the variables constituted by the velocity of the displacements and the pitch of the helices being varied, during the traverse of the current, according to a law determined as a function of the mass distribution along the element itself.

The above defined hardening process permits each element to be hardened and heated in a manner which is as homogeneous as possible, in that the support and advancement means can be actuated in a manner such as to impart to the element to be heated, during its stay within the heating station, not only a rotation about its longitudinal axis, but also axial to and fro displacements in such a way that each unit of length of the element to be tempered absorbs a quantity of heat proportional to its volume.

The process defined above further permits each element to be hardened and subjected to a continuous cooling in which the sections of the element are carried in succession in contact with the heat exchange fluid current for a time which, by suitably adjusting the support and advancement means, can be made substantially proportional to the areas of the sections themselves. In this way contributions to the substantially uniform cooling of the element are made both by the fact that the heat exchange takes place in the same way for all the points on the surface of the element because of its rotary movement about its axis during the transverse movement through the heat exchange fluid current, and by the fact that the transverse movement through the heat exchange fluid flowing in contact with the element, automatically carries away the cushions of steam which can form on the surface of the element itself.

Finally, therefore, the process described above makes it possible to obtain substantially homogeneous heating and cooling for hardened elements which have a substantially rectilinear configuration.

In addition to what has been described above, it is suitable to observe that the substantially continuous rotations about their longitudinal axes, imparted to the elements during their advancement along the conveyer, confers a substantially rectilinear configuration even to elements which were originally curved.

BRIEF DESCRIPTION OF THE DRAWINGS

The invention will now be described with reference to the attached drawings which illustrate a non limitative embodiment thereof, in which.

DETAILED DESCRIPTION OF THE INVENTION

Figure 1:
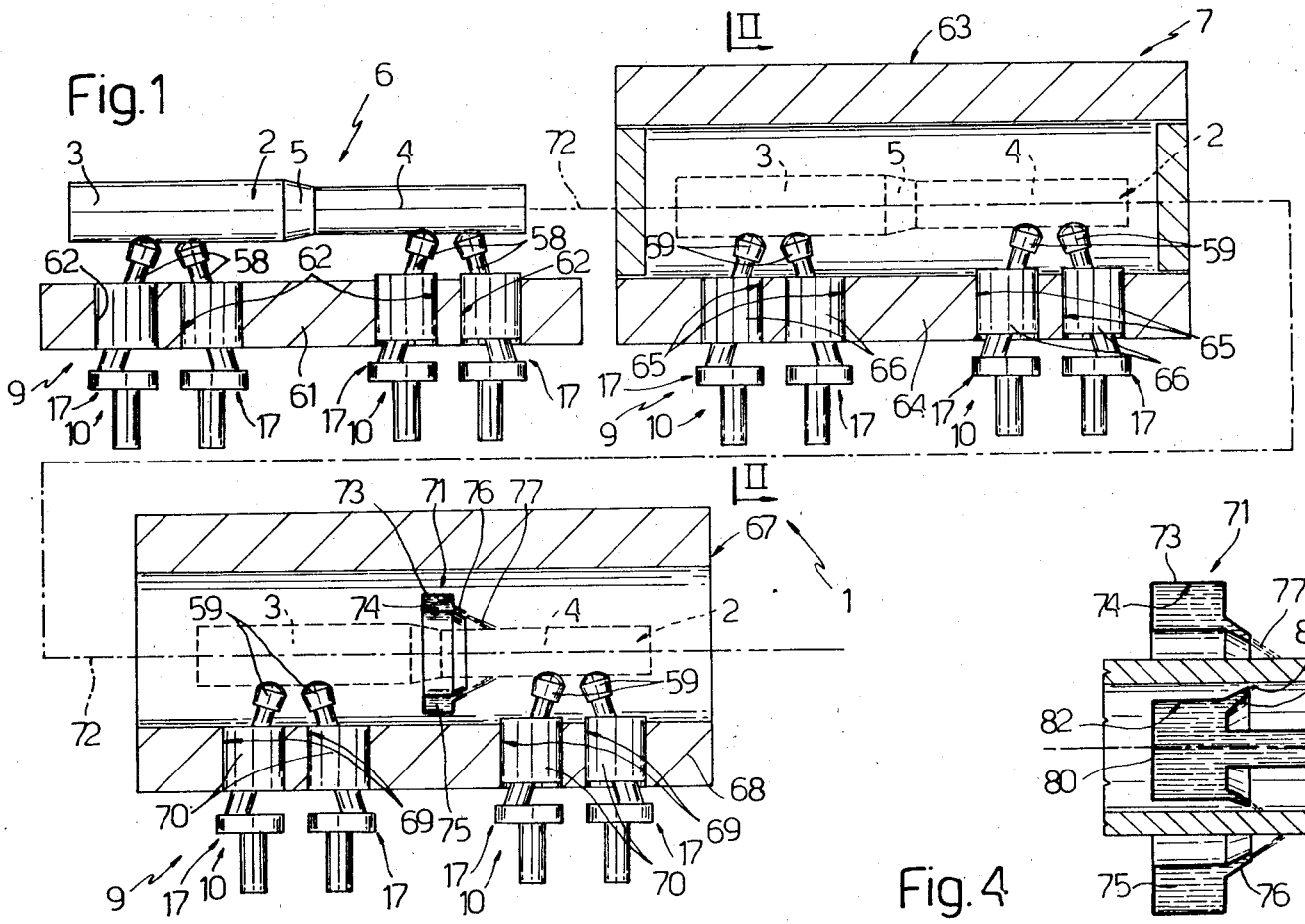
FIG. 1 schematically illustrates in axial section a system for hardening elongate elements according to the process of the present invention.

With reference to FIG. 1, the reference numeral 1 generally indicates a system for hardening elongate elements constituted, in the illustrated example, by rectilinear bars 2 having a variable circular section and, in particular, comprising, by way of example, a portion 3 of greater diameter and a portion 4 of smaller diameter, joined together by an intermediate connection section 5 of frusto-conical form.

The system 1 comprises an input station 6, an intermediate heating station 7 and a cooling or hardening output station 8.

Each bar 2 is made to advance through the stations 6, 7 and 8 by means of a conveyer device generally indicated 9 extending through the stations 6, 7 and 8 and comprising a succession of support and advancement units, each of which is generally indicated 10.

Figure 2:
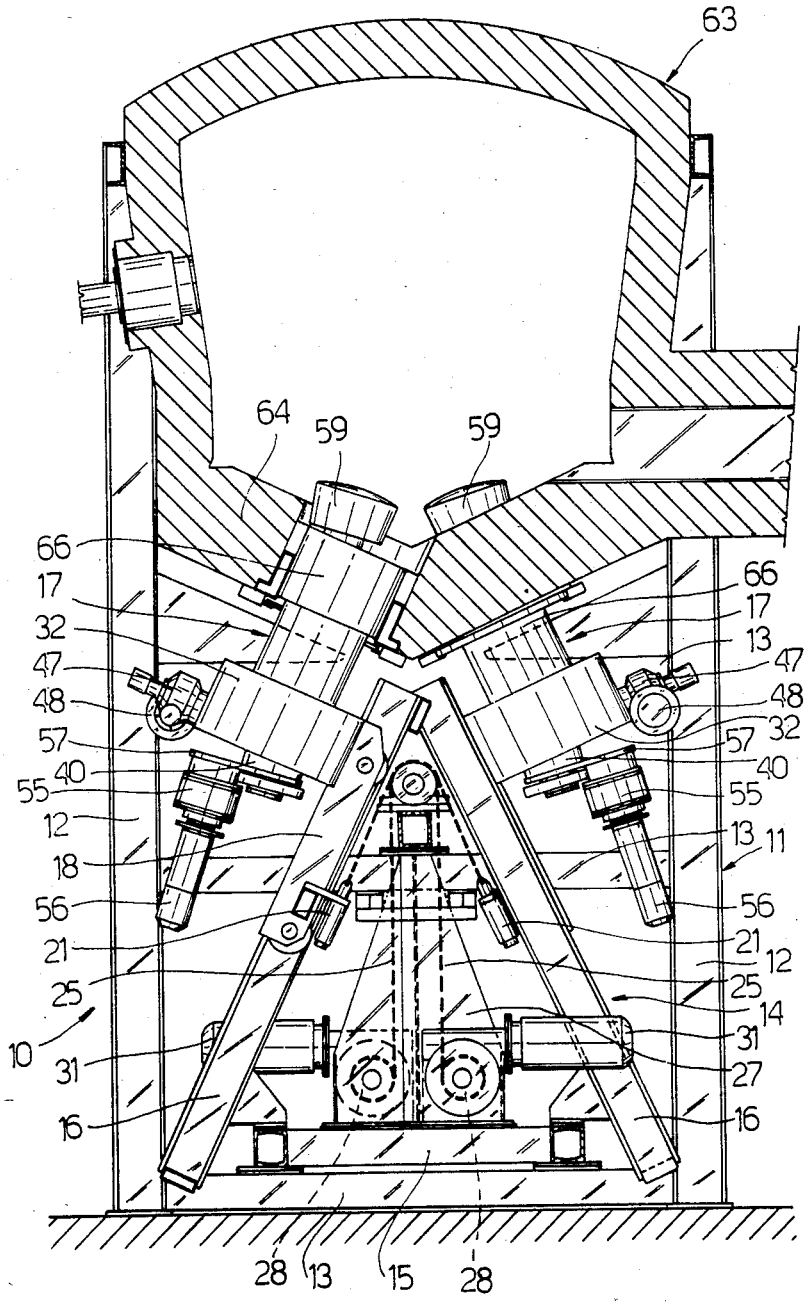
FIG. 2 is a section taken on the line II—II of FIG. 1.

As illustrated in FIG. 2, the units 10 are supported by a framework 11 comprising two lateral columns 12 joined together by crosspieces 13 and by a plurality of supports 14 having a substantially inverted V-shape, on each of which one unit 10 is mounted. Each support 14 comprises a base 15 from opposite edges of which extend upwardly two converging inclined beams 16 which can be either in the same plane or, as in the illustrated example, offset in the direction of advancement of the bars 2 along the conveyer device 9.

Each unit 10 includes two support and advancement devices 17 each supported by a respective guide beam 16. As illustrated, in particular, in FIG. 3, each device 17 includes a support carriage 18 provided with wheels 19 permit sliding of the associated carriage 18 along the associated beam 16. The carriage 18 is provided at its lower end with a projection 20 connected to a shock absorber cylinder 21 having an axis parallel to the axis of the beam 16. Within the cylinder 21 there is slidably mounted a piston 23 movable against the action of a spring 22, which piston is rigidly connected to a piston rod 24 extending upwardly and projecting out of the cylinder 21. The end of the rod 24 outside the cylinder 21 is connected to the end of a flexible transmission constituted, in the illustrated example, by a chain 25 which passes over a toothed sprocket 26 mounted rotatably on the top of a column 27 extending upwardly from the base 15 between the beams 16. The lower end of the chain 25 is rigidly connected to the perimeter of a second sprocket 28, which is keyed to an output shaft 29 of a reduction gearbox 30. One input of the reduction gearbox 30 is connected to the output of an electric motor 31 the action of which in one direction or the other causes displacement of the carriage 18 upwardly or downwardly along the associated beam 16.

From the surface of the carriage 18 opposite that which the projection 20 extends, outwardly, a toroidal body 32 rigidly connected to the carriage 18 and constituting, with the latter, a slide movable along the associated guide beam 16. The toroidal body 32 has an axis 33 parallel to the associated beam 16 and carries, connected to its inner cylindrical surface 34, two rings of conical rollers 35 rotatably carried by respective radial shafts 36, and the rolling tracks of which are constituted by two opposite frusto-conical surfaces 37 formed in the outer periphery of an annular flange 38. The flange extends radially outwardly from a hub or intermediate cylindrical body 39 coaxial to the axis 33 and integral with a cylindrical sleeve 40 projecting both upwardly and downwardly from the hub 39 and having an axial through hole 41 the axis 42 of which is oblique with respect to the axis 33 and forms an angle A with the latter.

To the lower surface of the flange 38 is rigidly connected a conical toothed ring 43 coaxial with the axis 33 and meshing with a bevel pinion 44 keyed on a shaft 45. The shaft 45 extends within a tubular body 46 mounted radially through the toroidal body 32 and constitutes the output shaft of a reduction gearbox 47 rigidly connected to one end of the tubular body 46 and driven by an electric motor 48. Within the hole 41 a shaft 50 is rotatably supported by means of bearings 49; a lower end portion 51 of the shaft 50 projects beneath the cylindrical sleeve 40 and carries a toothed wheel 52 keyed thereto. This latter meshes with a pinion 53 keyed on an output shaft of a reduction gearbox 55 connected to the output of an electric motor 56 and supported with the latter by the sleeve 40 via a bracket 57.

An upper end portion 58 of the shaft 40 projects above the sleeve 40 and carries connected thereto a driving head 59 delimited at the top by a surface 60 which, in the illustrated example, has the form of a spherical cap which can come into contact with the bar 2 to be conveyed in a manner which will be described hereinbelow.

As illustrated in FIG. 1, the input station 6 includes a sole plate 61 through holes 61 in which extend, in a slidable manner and with play, the upper portions 58 of the shafts 50 of the support devices 17 of a plurality of support units 10, only two of which are illustrated by way of example.

As illustrated in FIG. 2, the heating station 7 includes a horizontal furnace 63, the axial length of which is greater than that of the bars 3, and a sole plate 64 of which is provided with through holes 65 within each of which is rotatably and axially slidably mounted a sleeve 66 of insulating material coaxial with the hub 33 and surrounding the sleeve 40 and the upper portion 58 of the shaft 50 the head 59 of which projects above the sole plate 64 within the furnace 63 itself.

As illustrated in FIG. 1, the hardening station 8 includes a cooling tunnel 67 through a lower wall 68 of which are formed through holes 69 each of which is engaged in a rotatable and axially slidable manner by a respective sleeve 70 similar to the sleeves 66 and traversed by a respective shaft 50 of a respective support device 17.

As illustrated in FIG. 1, within the tunnel 67 there is disposed an ejector device 71 of annular form coaxial with an axis 72 of advancement of the bars 2. As illustrated in FIG. 1, the conveyer 9 advances the bars 2 in such a way as to maintain the longitudinal axis of the bars 2 in a position which is always substantially coincident with the axis 72.

In practice, within the tunnel 67 there is mounted a succession of ejector devices 71 only one of which is illustrated, for simplicity, in FIG. 1.

The ejector device 71 comprises a toroidal hollow element 73 defining within its interior an annular chamber 74 to which is supplied the heat exchange fluid 75, for example water. The toroidal element 73 is provided, on the side opposite that facing the output of the furnace 63, with a continuous annular nozzle 76 inclined towards the axis 72 and able to form, when the fluid 75 is supplied under pressure to the chamber 74, a current of fluid or jet 77 of conical form the vertex of which is disposed on the longitudinal axis 72 at a point (not illustrated) disposed downstream of the ejector device 71 in the sense of advancement of the bar 2.

Figure 4:
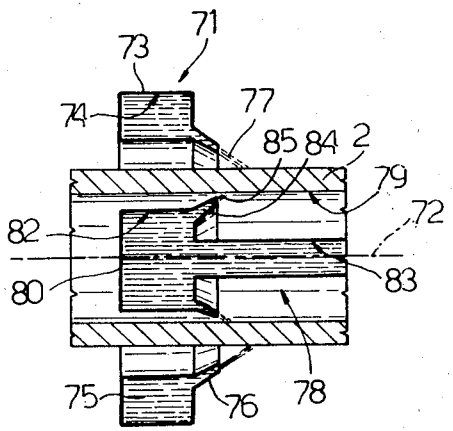
FIG. 4 illustrates on an enlarged scale and in axial section a detail of FIG. 1 modified to allow the hardening of tubular elements.

In the embodiment illustrated in the drawings, within the tunnel 67 there is mounted an ejector device 78 able to permit cooling of a hollow bar 2 and having an axial through hole 79. In this case, numerous ejector devices 78 are used, only one of which is illustrated for simplicity in FIG. 4, the number normally corresponding to that of the toroidal elements 73. The ejector device 78 comprises, as well as the toroidal element 73 provided with the conical annular nozzle 76, a piston 80 a rod 81 of which is connected to a drive device not illustrated, which can permit the piston 80 to be displaced into and out of the hole 79. Both the piston 80 and the rod 81 are hollow and define within their interior a chamber 82 and a duct 83 connected on one side to a device (not illustrated) for supplying the heat exchange fluid, and on the other side with a continuous annular nozzle 84 facing towards the end of the tunnel 67 opposite that facing the furnace 63 and operable to form a current or conical jet 85 directed towards the surface of the hole 79.

Obviously, the annular nozzles 76 and 84 can be replaced by a plurality of nozzles directed transversely of the axis 72 and distributed in annular rings in such a way as to form jets similar to the jets 77 and 85. Preferably, these nozzles, not illustrated, would have to be slightly inclined towards the output end of the tunnel 67 for the purpose of eliminating the possibility that heat exchange fluid can rise upstream along the bar 2 in question.

In use, the system 1 described above is supplied by means of the bars 2, which are disposed in succession above the unit 10 of the input station 6, which are controlled, as described, in such a way as to maintain the bars 2 with their longitudinal axes in substantially horizontal positions coinciding with the axis of advancement 72 of the bars 2 towards the heating station 7.

By actuation of the support devices 17 the bars 2 are transferred in succession, by means of displacement thereof imparted by the devices 17 in a manner which will be described below, into the furnace 63 of the station 7 where they remain for the length of time necessary for homogeneous heating thereof to reach the hardening temperature.

Within the furnace 63 each bar 2 is supported in contact with the heads 59 of the devices 17 which extend through the sole plate 64. These devices 17 are adjusted in a direction substantially transverse the bar 2 in such a way as to maintain the bar 2 with its axis always in a position substantially coinciding with the axis of advancement 72, and are driven in such a way as to impart to each point of the bar 2 displacements at a controllable velocity according to a respective cylindrical helix the pitch of which can be freely varied in a manner which will be described below, between zero and infinity. In this way it is possible to expose all the points of the surface of the bar in a substantially uniform manner to the source of heat in the furnace 63. Preferably, moreover, the devices 17 also impart to the bar 2 an axial to and fro movement within the furnace in such a way that the heat absorbed is, at the end of the heating, substantially constant for each unit of volume of the bar 2, and the temperature thereof is substantially homogeneous.

Once the heating phase is completed, each bar 2 is fed, by means of a displacement imparted by the devices 17 of the furnace 63, to the cooling or hardening station 8, the tunnel 67 of which is disposed in a position immediately adjacent an output end of a furnace 63 of such a way as to reduce to the minimum the path in free air of the bar 2. This latter is progressively supported by devices 17 which extend through the sole plate 68 of the tunnel 67, which maintain the bar 2 with its axis always in a position substantially coinciding with that of the axis 72 and impart to the bar 2 a rotary movement about the axis 72 and, simultaneously, an advancement along the axis 72.

During its axial displacement along the tunnel 67 each bar 2 is made to advance by the devices 17 always rotating about the axis 72, through the toroidal element 73 or rather, as already described, through the succession of elements 73 distributed along the tunnel 67 starting from a position close to the end of the tunnel 67 facing the furnace 63. Each toroidal element 73 directs its jet 77 onto the outer surface of the bar 2 in such a way as to create a current or "wall" of heat exchange or cooling fluid substantially transverse to the axis 72 and through which the bar 2 is caused progressively to advance.

In this way, not only is the cooling of the bar 2 progressive, but it substantially eliminates the possibility that cushions of insulating steam produced by the vaporization of the cooling fluid form on the surface of the bar 2 since the fluid, by continuously flowing in contact with the bar 2, whilst this turns abouts its axis, automatically carries away these cushions progressively as they form. What has been described for the ejector device 73 applies, obviously, also to the ejector device 78.

The rotational movements of the bar 2 about its axis 72 also contributes to the homogeneous cooling thereof. Because of this movement, in fact, all the points on the surface of the bar 2 are subjected to an identical action by the jet 77.

The laws according to which the pitches of the cylindrical helices travelled by points of the bar 2 when it is caused to advance through the ejector device 71 (78) also contribute to the homogeneous cooling of the bar 2, as does the angular velocity of the bar 2 about its own axis. The units 10 of the furnace 63 and the tunnel 67 can in fact be regulated in such a way as to vary the angular velocity and the pitch in dependence on the volume of the section of the bar 2 in contact at any instant with the transverse current. If, for example, the area of the sections of the bar to be cooled remain constant along the whole of the bar itself, both the angular velocity and the pitch can be maintained constant and their values will be chosen in such a way as to obtain a predetermined cooling upon passage of the bar itself through the ejector device 71 (78). In particular, the velocity and pitch will have preferably constant and relatively high values for relatively modest values of the area, and will have ever decreasing values for increasing values of the area.

In the case of the bar 2 illustrated, for example, holding constant the angular velocity the pitch will preferably have a predetermined constant initial velocity for the whole of the time in which the portion 4 of the bar 2 traverses the ejector device 71 (78) and will then fall in a substantially linear manner during the traverse of the ejector device 71 (78) by the conical connection section 5 until it reaches a minimum value which will be maintained constant for the whole of the time taken by the portion 3 to traverse the ejector device 71 (78).

Finally, then, it can be confirmed that, when a bar 2 starts to traverse the ejector device 71, its angular velocity and/or the pitch are preferably controlled in such a way that the time taken by each section of the bar 2 to traverse the jet 77 is directly proportional to the area of the section itself.

Figure 3:
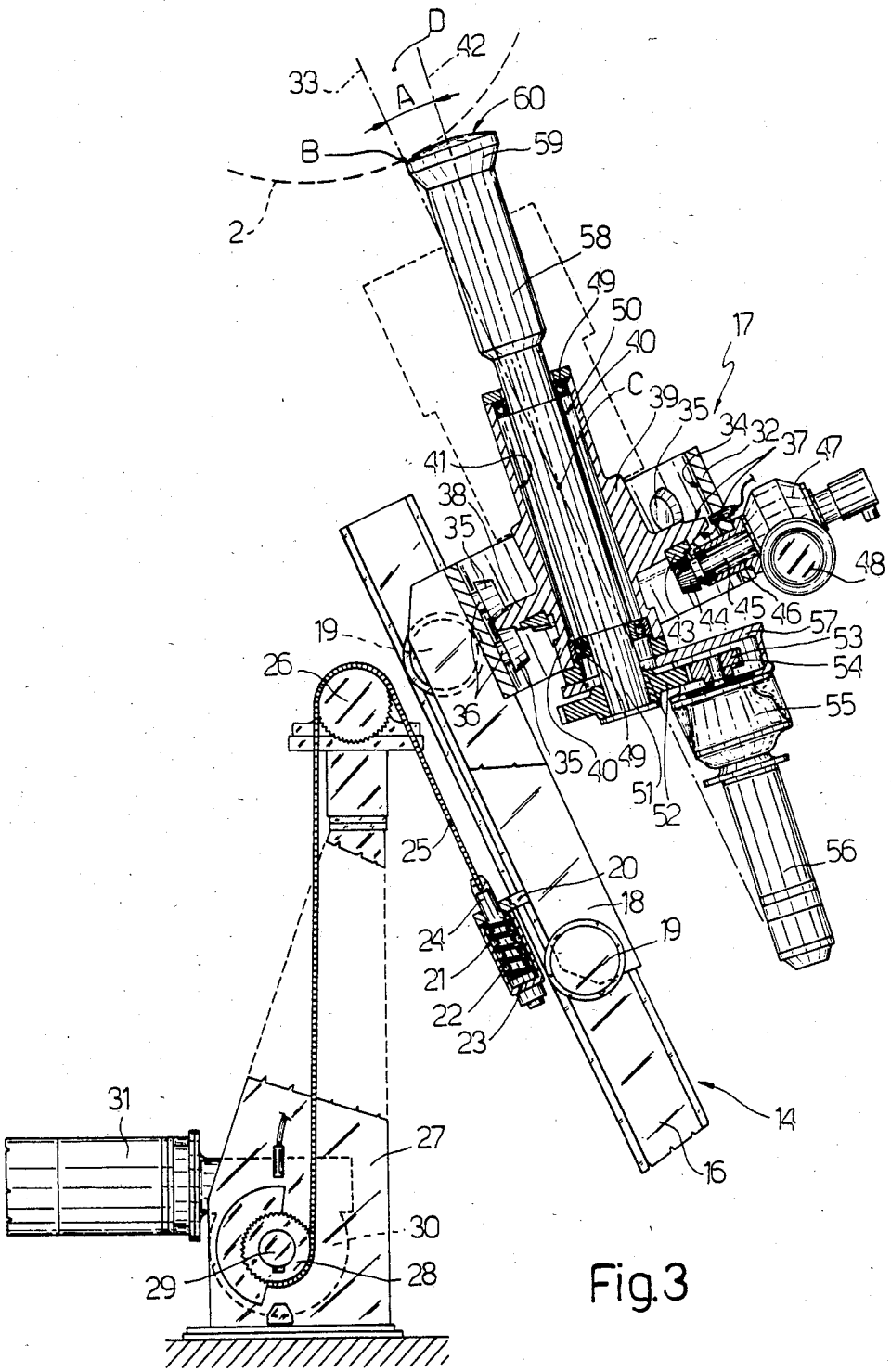
FIG. 3 illustrates on an enlarged scale, and partially in section, a detail of FIG. 2.

With reference to FIG. 3, there will now be described the manner in which it is possible, by means of the device 17, to support a bar 2 in a substantially horizontal position and make it advance axially, whilst maintaining constant its axis of advancement, at a velocity which can be required whilst imparting to it, at the same time, also a rotation abouts its own axis.

A bar is maintained with its axis in a substantially horizontal position coinciding with the axis 72 by means of an individual control of the motor 31 of each device 17. The operation of the motor 31 causes, in fact, by means of the chain 25, a displacement of the carriage 18 along the associated beam 16 and, therefore, an upward or downward displacement of the surface 60 of the head 59 on which the bar 2 rests. By actuating the motors 31 of the devices 17 it will therefore be possible to maintain the bar 2 with its axis in a horizontal position coinciding with the axis 72.

Obviously, if the bar 2 has an externally variable diameter, the motor 31 of each device 17 will have to be actuated in such a way as to raise the associated head 59 when the diameter of the bar 2 in correspondence therewith decreases, and to lower it when the diameter increases.

The axial displacement and rotation of each bar 2 about its axis and, therefore, the magnitude of the pitch of the cylindrical helix travelled by points on the bar 2, and the velocity with which the helices themselves are traversed are controlled by acting individually on the motors 48 and 56 of each device 17.

As illustrated in FIG. 3, the outer surface of the bar 2 rests on the surface 60 of the head 59 of a given device 17 at a point B disposed a certain distance from the axis 42. In the illustrated example the point B is a point on the axis 33 but it could possibly be any point on the surface 60 (the centre of which is preferably disposed at a point C where the axes 33 and 42 intersect) with the exception of the point of intersection between the surface 60 and the axis 42.

If the motor 56 is rotated, the point B displaces on the surface 60 along a circumference with a centre on the axis 42, whilst it performs on the surface of the bar 2 displacements which are at any instant in a direction tangential to the said circumference of the instantaneous contact point B or perpendicular to the radius of the circumference passing through the instantaneous point of contact B. In space, the contact between the bar 2 and the surface 60 takes place at a fixed point B which lies, in any case, on a plane D defined by the axes 33 and 42. Thus, therefore, the instantaneous displacement of the point B along the surface of the bar 2 is always tangential to the surface of the bar 2 and perpendicular to the plane D.

By acting on the motor 48 it is possible to make the plane D rotate about the axis 33 and, therefore, to vary the direction of the instantaneous displacement of the point B on the surface of the bar 2.

Bearing in mind that, as described, in reality the point B, with the motor 48 stopped, is fixed in space and that, therefore, the displacements to the point B described above correspond to equal and opposite displacements of the head 59 and of the bar 2, it can be stated that, when, as in the example illustrated in FIG. 3, the plane D is perpendicular to the axis 72, the operation of the motor 56 corresponds to a purely axial translation of the bar 2. If, on the other hand, the motor 48 is operated in such a way as to turn the plane D to dispose it in a position parallel to the axis 72, the actuation of the motor 56 causes a pure rotation of the bar 2 about its axis 72. For any intermediate position of the plane D there will be obtained an axial displacement and a simultaneous rotation of the bar 2 with a linear velocity and, respectively, an angular velocity which can be controlled by varying both the speed of rotation of the head 59 by means of the motor 56 and the position of the plane D by means of the motor 48.

Whilst discussing the position of the point B on the surface 60 it is suitable to explain that the optimum conditions are obtained when the point B lies on the axis 33 and this latter passes through the axis 72. In fact, if these conditions are not satisfied, upon operation of the motor 48 there corresponds a displacement of the point B in space, which takes place along the circumference with a centre on the axis 33 and which is translated into a sliding of the surface 60 on the surface of the bar 2.

Obviously, the sliding is nil if, as in the example illustrated, the conditions are satisfied.

Further to what has been explained above, it is suitable to state that the sliding does not involve significant disadvantages and is largely tolerable above all in the case in which the hardened bar must be subjected to subsequent mechanical surface working with removal of shavings.

Finally, it is suitable to note that the advancement of each bar 2 along the conveyer device 9 according to the laws and in the manner previously described is theoretically possibly by manually controlling the motors 31, 41 and 56 of each element 17. In practice, however, it is preferable to control the advancement of each bar 2 by position sensors (not illustrated) connected to a central controlling computer unit (not illustrated) which actuates the motors 31, 48 and 50 in accordance with predetermined programmes.

I claim:

1. A process for hardening elongated metal elements, in particular both solid and tubular rectilinear circular section bars, having constant or variable section, and of extended length, characterized by the fact that it comprises the steps of:

positioning each said element (2) to be hardened on a conveyer device (9) extending through a heating station (7) and a hardening, cooling station (8), and comprising a succession of rotatable support and advance means (17) individually adjustable in position and direction substantially transverse to said element (2), and individually operable in a controllable manner to impart to each point of said element (2) displacements having a controllable velocity along a respective cylindrical helix maintained, by means of said control of said rotatable support and advancement means in a direction transverse to said element, always substantially coaxial with an axis of advancement (72) of the element (2) along said conveyer device (9), the pitch of said helix being adjustable from point to point of said conveyer (9) between a value of zero and an infinite value;

advancing each said element (2) within said heating station (7) by means of said conveyer (9);

maintaining each said element (2) within said heating station (7) for a predetermined time imparting to it, by means of said rotatable support and advancement means (17), at least a rotation about said axis of advancement (72);

providing, within said cooling station (8), at least one current of heat exchange fluid substantially transverse to said axis of advancement (72); and advancing each said element (2) through said current of fluid imparting to the points thereof displacements according to respective said cylindrical helices; at least one of the variables constituted by the velocity of said displacements and the pitch of said helices being varied, during the traverse of said current, according to the mass distribution along the element (2) itself.

2. A process according to claim 1, characterized by the fact that said variables are controlled in a manner such that the time taken for each transverse section of said element (2) to transverse said current of fluid is directly proportional to the area of the section itself.

3. A method according to claim 1, characterized by the fact that said current is formed at least in part by an annular source (71) through which each said element is caused to pass.

4. A method according to claim 3, characterized by the fact that said element is hollow; parts of said current flow over an inner surface of said element and are formed by means of a further annular source.

5. A method according to claim 3, characterized by the fact that each said annular source (71,78) is formed by an annular conical nozzle (76,84) having an axis substantially coinciding with said axis of advancement (72) and directed towards said element (2) in the direction of advancement of said element (2) through said current of cooling fluid.

6. A method according to claim 1, characterized by the fact that each said element (2) has an axial to and fro movement imparted thereto within said heating station (7).

7. A process according to claim 1, characterized by the fact that said rotatable support and advancement means comprise a succession of support and advancement devices (17), each of which comprises a guide (16) extending parallel to the first axis (33) transverse said axis of advancement (72); slide means (18,32) movable along said guides (16); first actuator means (31,25) for displacing said slide means (18,32) along said guide; a shaft (50) carried by said slide means (18,32), said shaft (50) being rotatable about a second axis (42) coinciding with its longitudinal axis and forming a given angle (A) with said first axes (33); an intermediate body (39) supported by said slide means (18,32) and rotatable about said first axis (33), said intermediate body (39) supporting said rotatable shaft (50); and second (56) and third (48) actuator means for rotating said shaft (50) and said intermediate body (39) about said second (42) and first (33) axes respectively.

8. A process according to claim 7, characterized by the fact that said first actuator means (31,25) comprise a motor (31) and a flexible transmission (25) interposed between said motor (31) and said slide means (18,32); a damper (21) being interposed between said slide means (18,32) and said transmission (25).

9. A process according to claim 7, characterized by the fact that said slide means (8,32) comprise a toroidal body (32) coaxial with said second axis (42) and rotatably mounted within said toroidal body (32) to turn about said first axis (33) under the thrust of said third actuator means (48); said shaft (50) being mounted through said sleeve (40) to turn with respect to the latter about said second axis (42) under the thrust of said second actuator means (56).

10. A process according to claim 1, characterized by the fact that said shaft (5) is provided with a head (59) operable to support a said element (2) coming into contact with the outer surface thereof at a point (B); said contact point (B) performing, on said head (59), upon rotation of said shaft (50) about said second axis (42), a circumferential path the centre of which is disposed on said second axis (42).

11. A process according to claim 10, characterized by the fact that said first axis (33) intersects said axis of advancement (72) and passes through said point of contact (B).

12. A process according to claim 10, characterized by the fact that said circumference lies on a spherical surface (60), the centre of which coincides with a point (C) of intersection between said first (33) and second (42) axes.

* * * * *